US009352938B2

(12) United States Patent
Lidón et al.

(10) Patent No.: US 9,352,938 B2
(45) Date of Patent: May 31, 2016

(54) LIFTING SYSTEM FOR LOW PROFILE ELEMENT BASKETS FOR ROTARY REGENERATIVE AIR PREHEATERS

(71) Applicant: Howden UK Limited, Belfast (IE)

(72) Inventors: José Jesús Cerezo Lidón, Orihuela-Alicante (ES); Alfonso Asensio Martínez, Vista Alegre-Cartagena (ES); David López Teruel, La Unión-Murcia (ES)

(73) Assignee: Howden UK Limited, Belfast (IE)

( * ) Notice: Subject to any disclaimer, the term of this patent is extended or adjusted under 35 U.S.C. 154(b) by 0 days.

(21) Appl. No.: 14/248,558

(22) Filed: Apr. 9, 2014

(65) Prior Publication Data

US 2014/0327259 A1 Nov. 6, 2014

(30) Foreign Application Priority Data

May 3, 2013 (EP) ..... 13382164

(51) Int. Cl.
*B66F 19/00* (2006.01)
*B66C 1/10* (2006.01)
*F28D 19/04* (2006.01)

(52) U.S. Cl.
CPC ..... *B66C 1/10* (2013.01); *F28D 19/044* (2013.01)

(58) Field of Classification Search
CPC ..... B65D 2519/00059; B65D 2519/00288; B65D 90/0033; B65D 19/385; B65D 19/00323; B65D 2519/00273; B65D 21/0213; B65D 21/0215; B65D 88/121; B65D 2519/00024; B66C 1/16; B66C 1/62; B66C 1/663; B66C 1/24; B66C 1/02; B66C 1/10; A47F 7/30; A47F 5/13; F28D 19/048; F28D 19/044; Y02E 60/145; F28F 9/0246; B21D 53/085
USPC ..... 294/215
See application file for complete search history.

(56) References Cited

U.S. PATENT DOCUMENTS

| | | | | |
|---|---|---|---|---|
| 1,834,902 | A * | 12/1931 | Payzant | 294/67.4 |
| 4,227,854 | A | 10/1980 | Coffey | |
| 4,557,318 | A | 12/1985 | Bellows | |
| 5,119,885 | A | 6/1992 | Johnson | |
| 5,522,633 | A * | 6/1996 | Massi | 294/81.52 |
| 6,039,500 | A * | 3/2000 | Kwon | 403/78 |
| 6,267,422 | B1 * | 7/2001 | Alba | 294/215 |
| 6,640,880 | B1 | 11/2003 | Updyke et al. | |
| 2010/0078950 | A1 * | 4/2010 | Inda | 294/1.1 |
| 2011/0285156 | A1 * | 11/2011 | Kaybidge et al. | 294/82.1 |

* cited by examiner

*Primary Examiner* — Stephen Vu
(74) *Attorney, Agent, or Firm* — Kacvinsky Daisak Bluni PLLC

(57) ABSTRACT

A lifting lug is disclosed for use with a low profile heater basket. The lifting lug can include a corner portion including first and second legs. The first and second legs are coupled to each other at respective first ends. The first and second legs can be oriented at an angle with respect to each other. The angle can be from 82.5-degrees to 97.5-degrees. The lifting lug can further include a hook engaging portion having first and second ends connected to respective second ends of the first and second legs. The hook engaging portion has a cylindrical cross-sectional shape. Further, an outer surface of the hook engaging portion is recessed from a bottom surface of a plane formed by bottom surfaces of the first and second legs. Other embodiments are disclosed and claimed.

20 Claims, 12 Drawing Sheets

LIFTING SYSTEM FOR LOW PROFILE ELEMENT BASKETS FOR ROTARY REGENERATIVE AIR PREHEATERS

CROSS-REFERENCE TO RELATED APPLICATIONS

This application claims priority to pending EP Patent Application No. 13382164.5, filed May 3, 2013, titled "Lifting System for Low Profile Element Baskets for Rotary Regenerative Air Preheaters," which is incorporated herein by reference in its entirety.

BACKGROUND OF THE INVENTION

1. Field of the Invention

Embodiments of the invention generally relate to heater baskets for use in rotary regenerative air preheaters, and more particularly to an improved lifting system for use with low profile heater baskets.

2. Discussion of Related Art

Rotary regenerative air preheaters use heat transfer surfaces called heating elements that are packed into baskets for easy handling and removal. Low profile baskets, such as the basket 1 shown in FIG. 1, are used when it is desired to maximize the profile height of the heating elements in order to maximize the thermal performance of the air preheater and where there is a restriction in available height due, for example, to the existing dimensions of the regenerative heater's rotor/stator, where the new heating elements baskets are to be installed.

The configuration of the low profile basket 1 minimizes the total height of the basket's side grids 2, which maximizes the height of the heating elements while maintaining the same basket outer dimensions. In this particular type of basket, the lifting lugs 4 are positioned at the corners 6 of the basket 1, since it is feasible to use the side grids 2 to lift the basket 1.

Previous lifting lugs 4 consisted of flat plates cut to conform to the inner shape of the basket angles. These flat plates were welded to the corner of the basket, and included a threaded hole 8 for engaging a threaded eyebolt 10 which, in turn, was coupled to a set of steel chain/wire rope slings 12 used as standard lifting equipment.

Such prior arrangements suffer from the problem that over time, they degrade and must be rethreaded. For example, the repeated insertion and removal of the threaded eyebolt 10 can cause wear on the threads of the threaded hole 8. Seizing of the threads, misthreading, and stripping of threads is also a problem which can require costly repair from both a material and time standpoint. In addition, the threads and plates are subject to corrosion, which can also cause problems with proper installation and engagement of the threaded eyebolt. Thus, there is a need for an improved lifting arrangement for low profile heater baskets.

SUMMARY OF THE DISCLOSURE

A lifting lug is disclosed for use with a low profile heater basket. The lifting lug may include a corner portion including first and second legs, the first and second legs coupled to each other at respective first ends thereof. The first and second legs may be oriented at an angle with respect to each other. The lifting lug may also include a hook engaging portion having first and second ends coupled to respective second ends of the first and second legs. In some embodiments the hook engaging portion has a cylindrical cross-sectional shape. An outer surface of the hook engaging portion may be recessed from a plane formed by bottom surfaces of the first and second legs.

The second ends of the first and second legs may each include a longitudinal notch formed in a side surface of the associated leg. The angle between the first and second legs may be from 82.5-degrees to 97.5 degrees. The first and second legs may have flat upper and lower surfaces. The first and second legs and the hook engaging portion may have a triangular shape. The first and second legs and the hook engaging portion may form an opening therebetween. The opening may be pentagonal in shape.

A lifting arrangement is disclosed for a low profile heater basket. The lifting arrangement may include a plurality of grid members coupled together to form a heater basket frame, and a plurality of lifting lugs coupled to respective corners of said heater basket frame. Each of the lifting lugs may include a corner portion including first and second legs, and a hook engaging portion having first and second ends coupled to respective second ends of the first and second legs. The first and second legs of each of the lifting lugs may be configured to conform with respective corners of the heater basket frame. Side surfaces of the first and second legs of each of the lifting lugs may be recessed from respective side surfaces of said respective corners.

The side surfaces of the first and second legs may be welded to the respective corners. The first and second legs of each of the lifting lugs may include a longitudinal notch formed in a side surface thereof, where at least one longitudinal notch is aligned with an adjacent grid member to align the associated lifting lug with the heater basket frame. The hook engaging portion may have a cylindrical cross-sectional shape. An outer surface of the hook engaging portion can be recessed from a plane formed by bottom surfaces of the first and second legs of the corner portion.

The first and second legs of the corner portion may be angled with respect to each other. In some embodiments the angle can be from 82.5-degrees to 97.5 degrees. The first and second legs may have flat upper and lower surfaces. The first and second legs and the hook engaging portion may form a triangular shape. The first and second legs and the hook engaging portion may form an opening therebetween. In some embodiments the opening is pentagonal in shape.

The lifting arrangement may further include a plurality of hook elements for releasably engaging respective hook engaging portions of the plurality of lifting lugs. The lifting arrangement may also include a plurality of shackles for engaging the plurality of hook elements, and a sling attached to the plurality of shackles, the plurality of shackles, the plurality of hook elements, and the sling for lifting the heater basket frame via said plurality of lifting lugs.

BRIEF DESCRIPTION OF THE DRAWINGS

The accompanying drawings illustrate preferred embodiments of the disclosed method so far devised for the practical application of the principles thereof, and in which.

DESCRIPTION OF EMBODIMENTS

Figure 3:
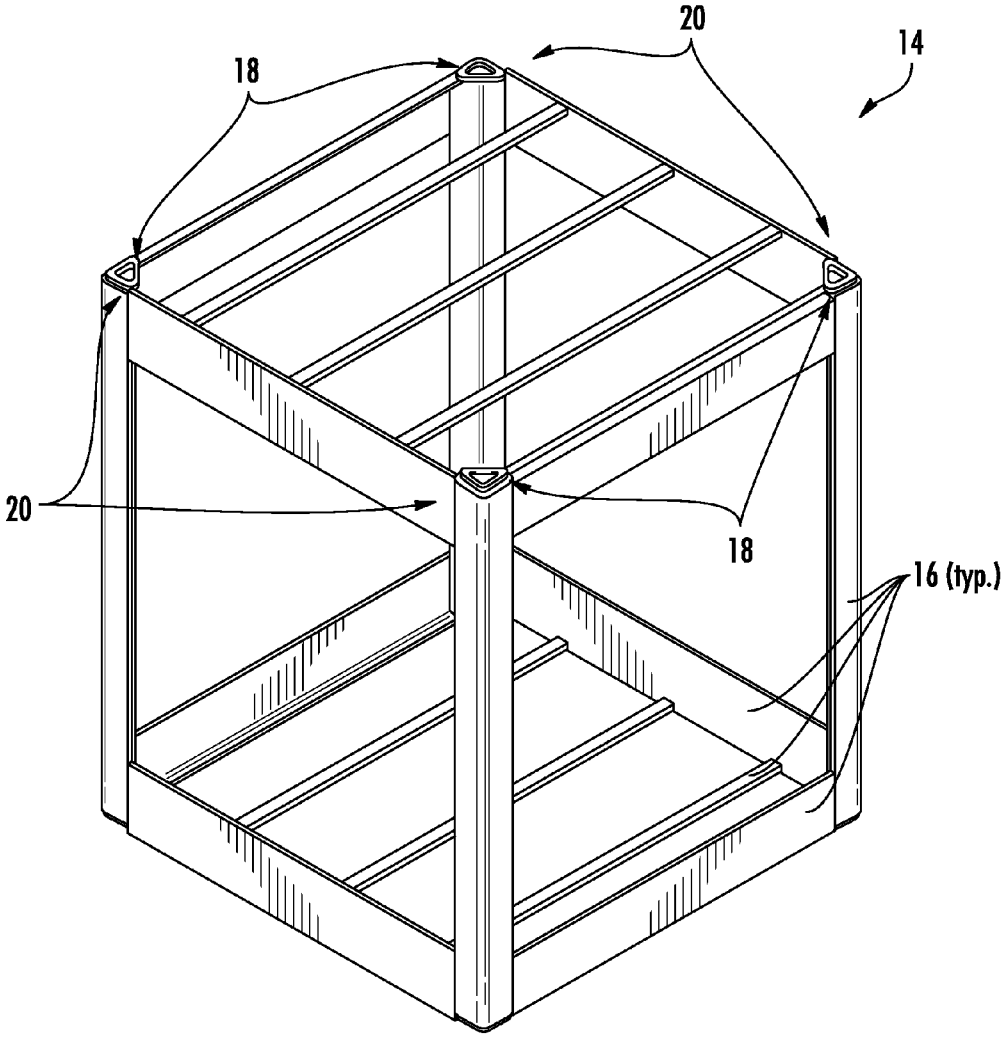
FIGS. 3 is an isometric view of an exemplary low profile heater basket (empty) according to the disclosure.
Figure 4:
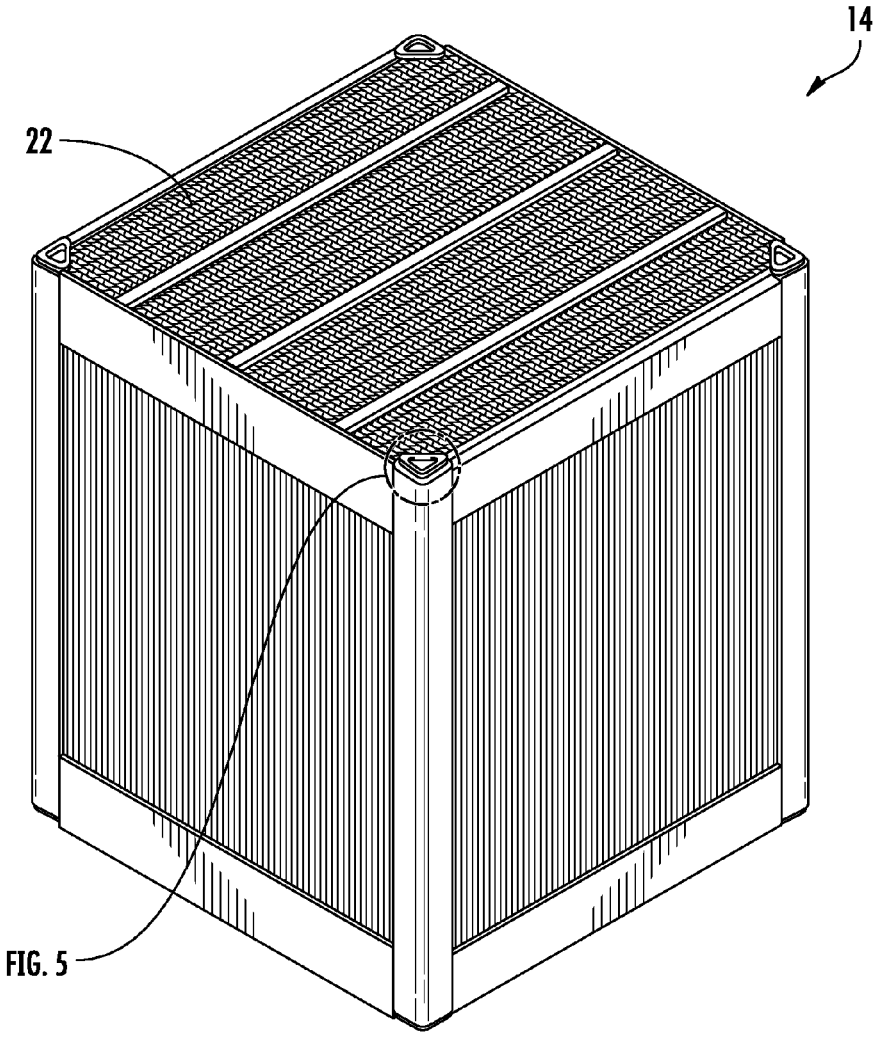
FIG. 4 is an isometric view of the basket of FIG. 3 filled with heating elements.

An improved lifting arrangement is disclosed for use with low profile heater baskets. The improved lifting arrangement addresses the deficiencies encountered with prior arrangements. Referring to FIG. 3, an exemplary heater basket 14 is shown. For clarity, the heater basket 14 is shown without the heating elements installed. As can be seen, the heater basket 14 is generally box-shaped, and is formed from a plurality of vertical and horizontal structural grid members 16. A plurality of lifting lugs 18 are engaged with respective ones of the structural grid members 16 at the end corners 20 of the heater basket 14. Although the lifting lugs 18 are shown engaged with a set of top end corners of the heater basket 14, it will be appreciated that lifting lugs can also be provided on the bottom end corners of the heater basket (for a total of eight lifting lugs per heater basket). FIG. 4 shows the heater basket 14 if FIG. 3 filled with heating elements 22.

Figure 1:
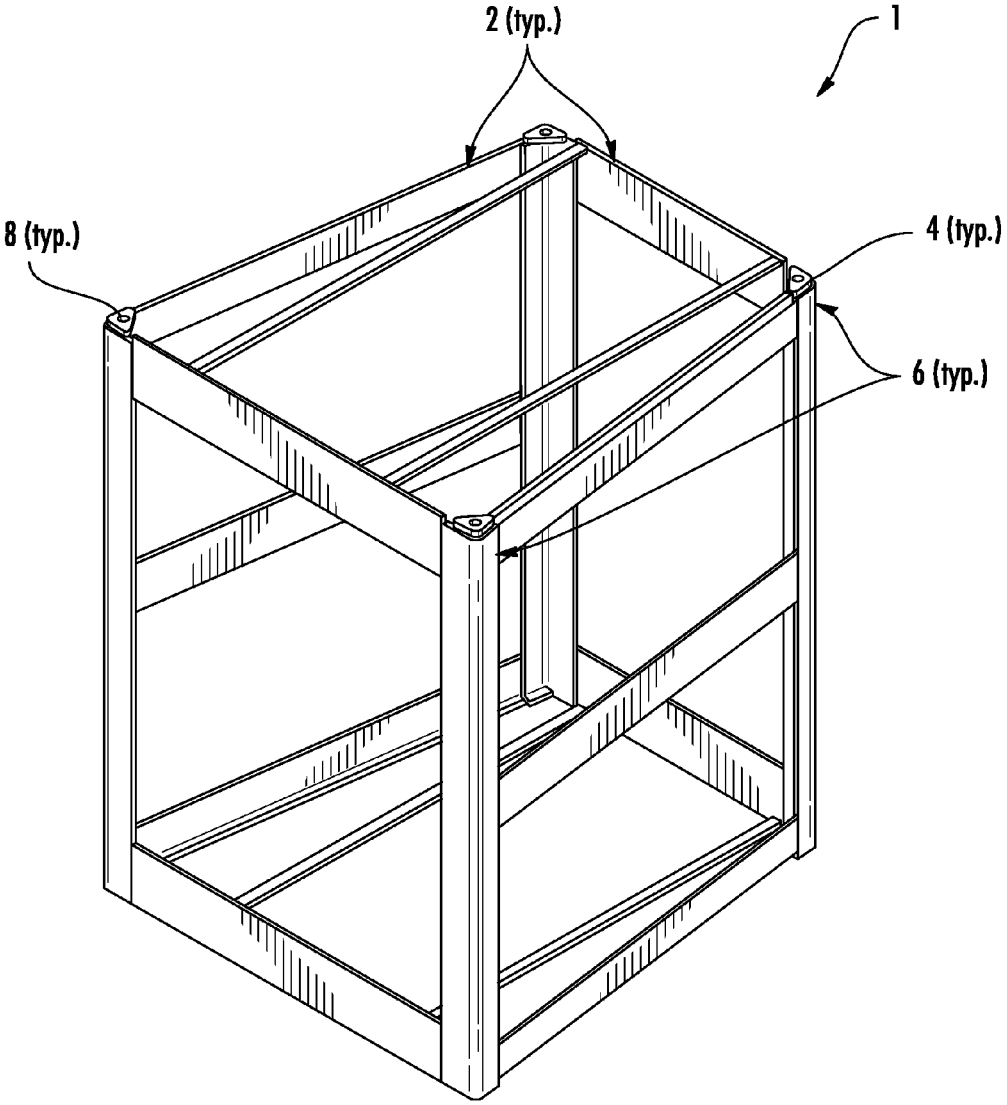
FIG. 1 shows a conventional low profile heater basket, in the empty condition.
Figure 2:
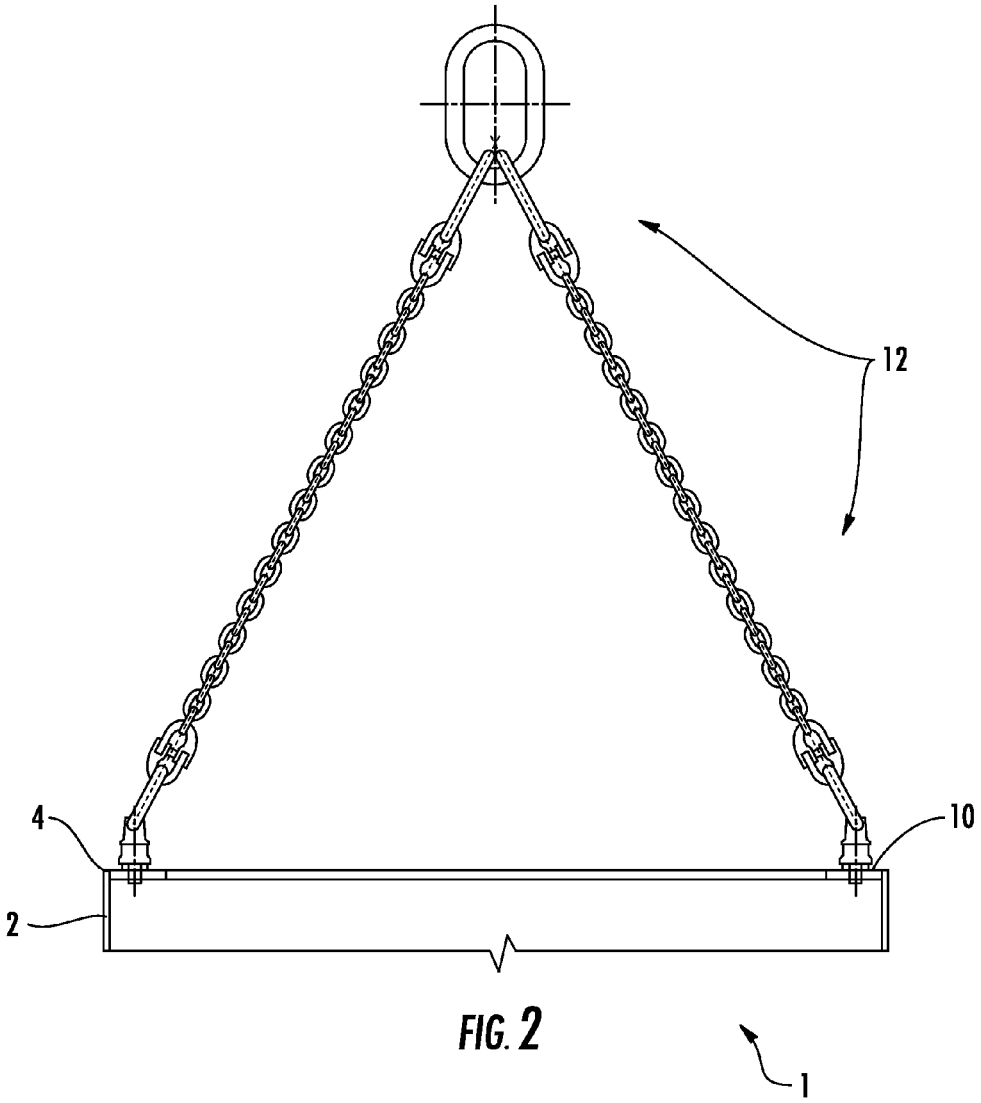
FIG. 2 shows a conventional lifting arrangement for use with the basket of FIG. 1.
Figure 5:
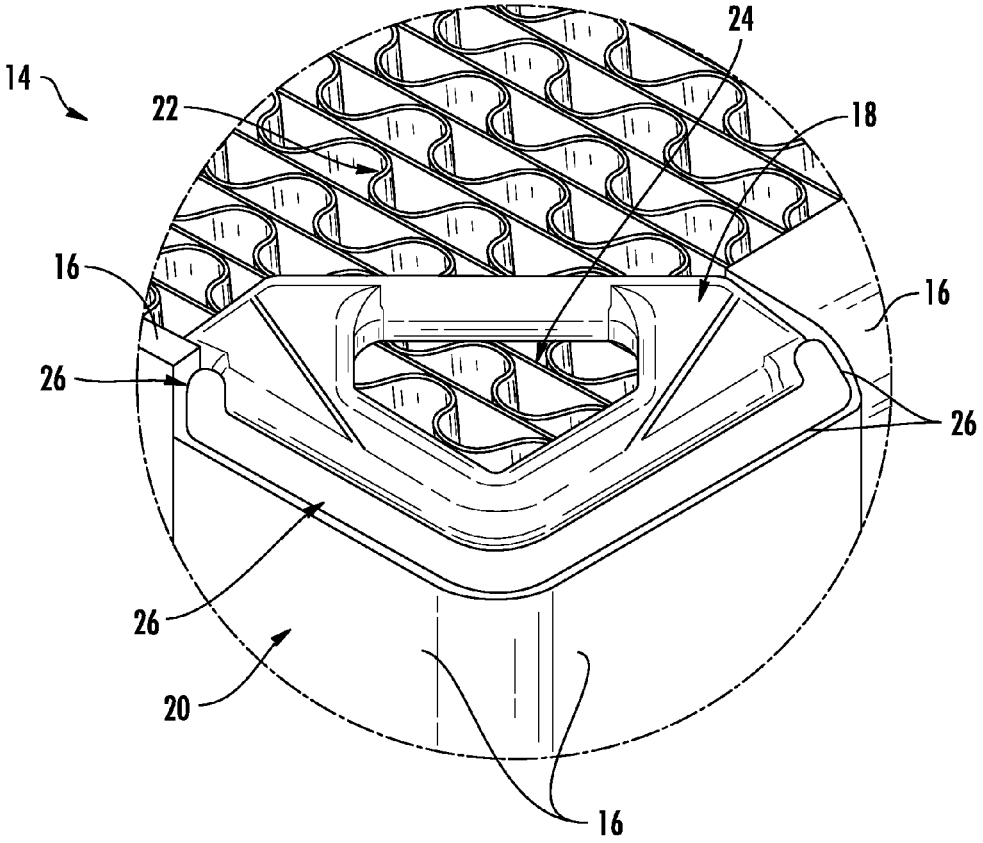
FIG. 5 is a detail isometric view of the disclosed lifting lug engaged with the low profile basket of FIG. 4.
Figure 6:
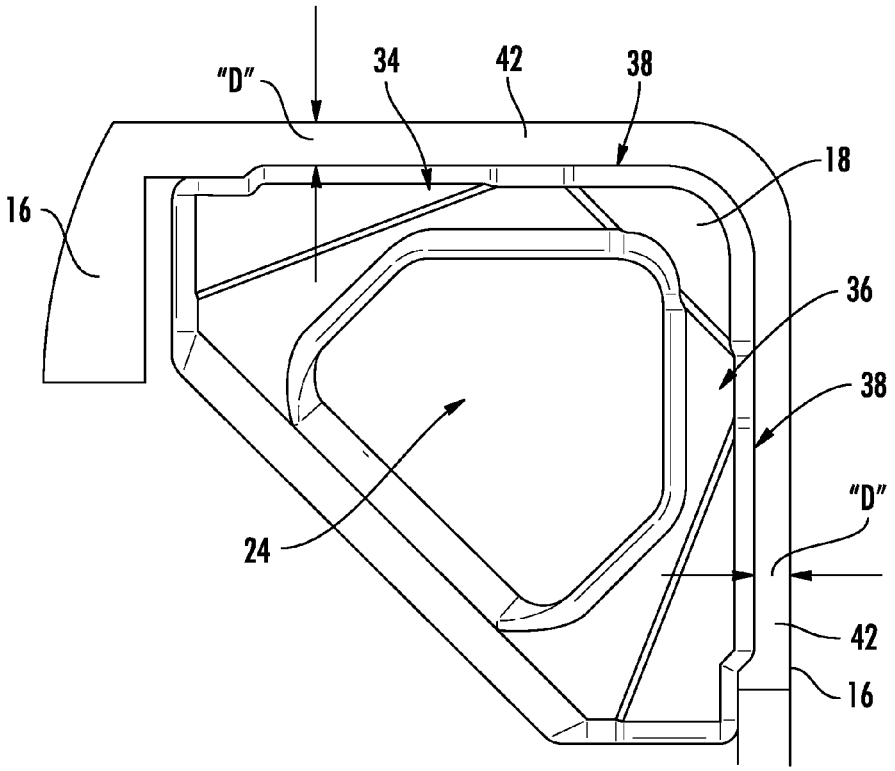
FIG. 6 is a top plan view of the lifting lug arrangement of FIG. 5.

FIG. 5 is a detail view of one of the lifting lugs 18 engaged with an end corner 20 of the heater basket 14 of FIG. 4. As can be seen, a portion of the lifting lug 18 overlies the heating elements 22 disposed within the heater basket. Advantageously, the lifting lug 18 includes a wide central opening 24 to minimize the impact that the lug has on gas flow through the heater basket. This is an advantage compared to prior designs whose "opening" consisted of a threaded hole 8 (see FIG. 1), such that a majority of the lifting lug 4 blocked gas flow at the corners of the heater basket 1. In the illustrated embodiment, fillet welds 26 are used to fix the lifting lugs 18 to the grid members 16 forming the end corners 20 of the heater basket 14. FIG. 6 is a plan view of the lifting lug 18 engaged with the end corner of FIG. 5. As can be seen, the lifting lug 18 conforms to the shape of the end corner 20 of the heater basket.

Figure 7:
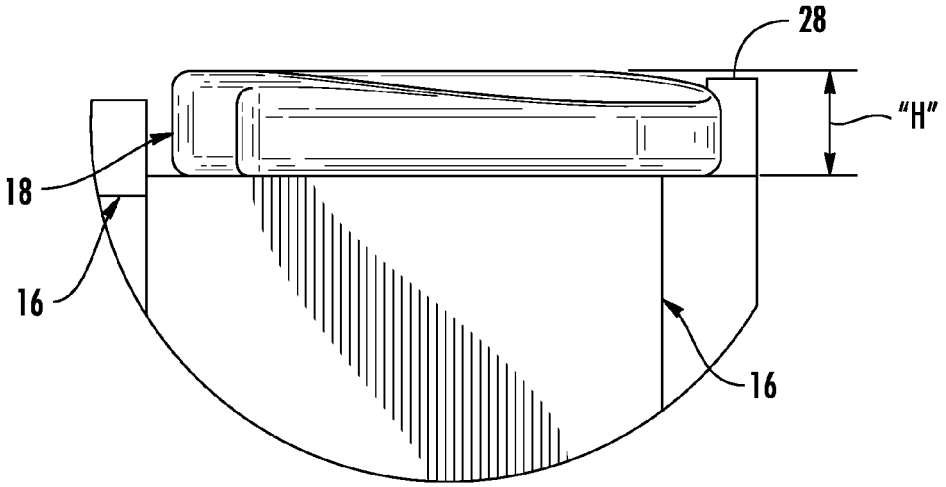
FIG. 7 is a side view of the lifting lug of FIG. 6.

FIG. 7 is a side view of the lifting lug 18 engaged with the grid members 16 forming the end corner 20. As can be seen, the height "H" of the lifting lug 18 is such that it is substantially flush with the top surface 28 of the grid member 16, thus preserving the low profile nature of the heater basket 14.

Figure 8B:
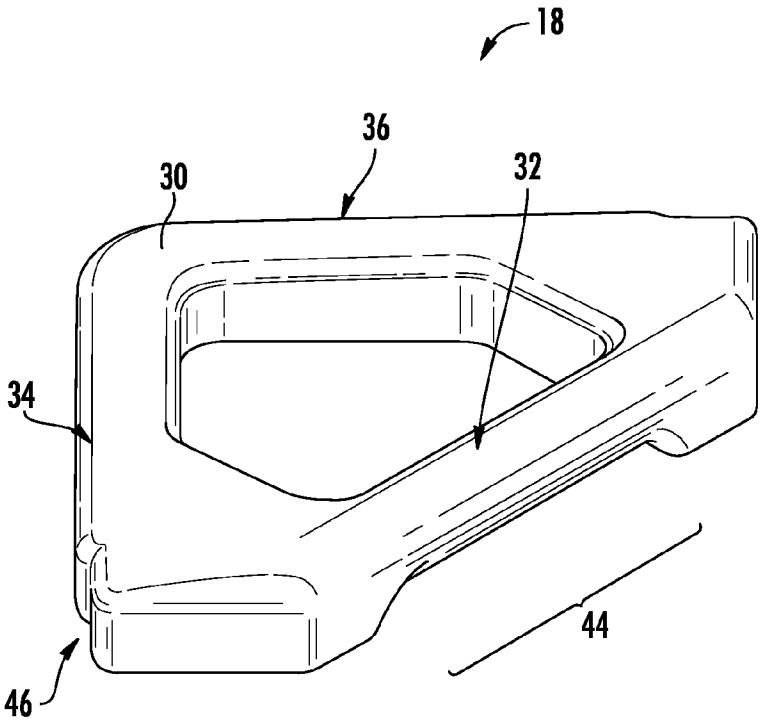
FIGS. 8A and 8B are isometric and reverse isometric views of the disclosed lifting lug.
Figure 8A:
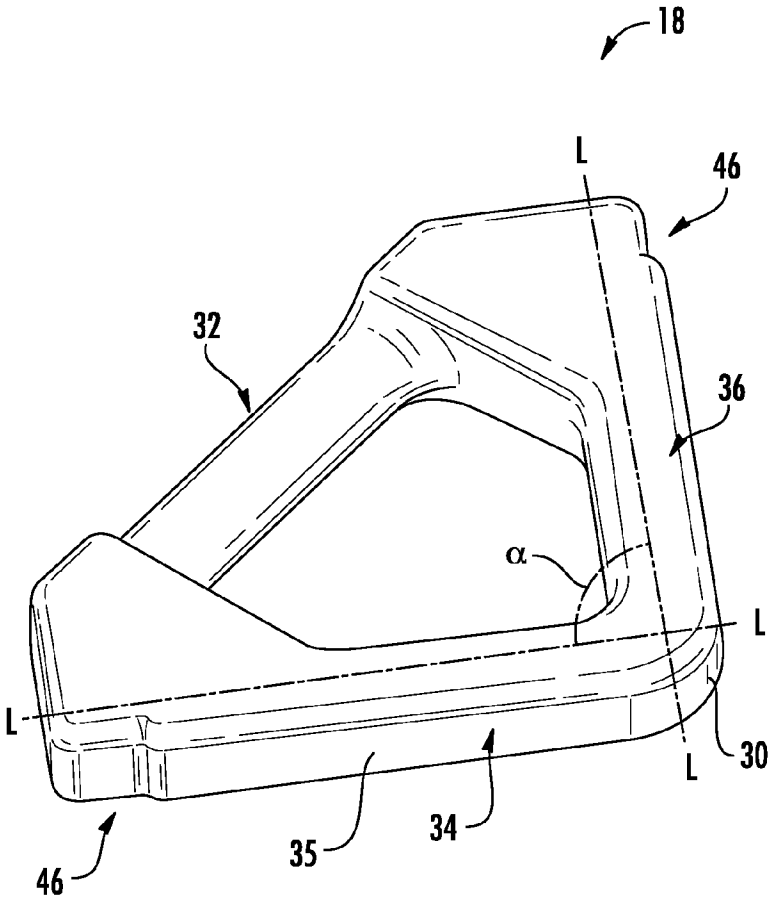

FIGS. 8A and 8B show details of the disclosed lifting lug 18. As can be seen, the lifting lug 18 has a generally triangular shape, including a corner portion 30 and a hook engaging portion 32. The corner portion 30 is generally flat, and comprises a pair of legs 34, 36 each having a rectangular shape in cross-section. The corner portion 30 is sized to conform in shape to the corner geometry formed by the grid members 16 that constitute the corner end 20 of the heater basket (see FIG. 3). As can be seen in FIG. 6, the legs 34, 36 of the corner portion 30 are sized so that their outer surfaces 38 are offset from an outer surface 40 of the heater basket 14 by an offset distance "D." This offset distance "D" is selected to ensure that the corner portion 30 can rest on an upper surface 42 of the associated grid members 16, while still providing sufficient surface area on the upper surface 42 to enable fillet welding of the lifting lug 18 to the grid members.

Figure 9:
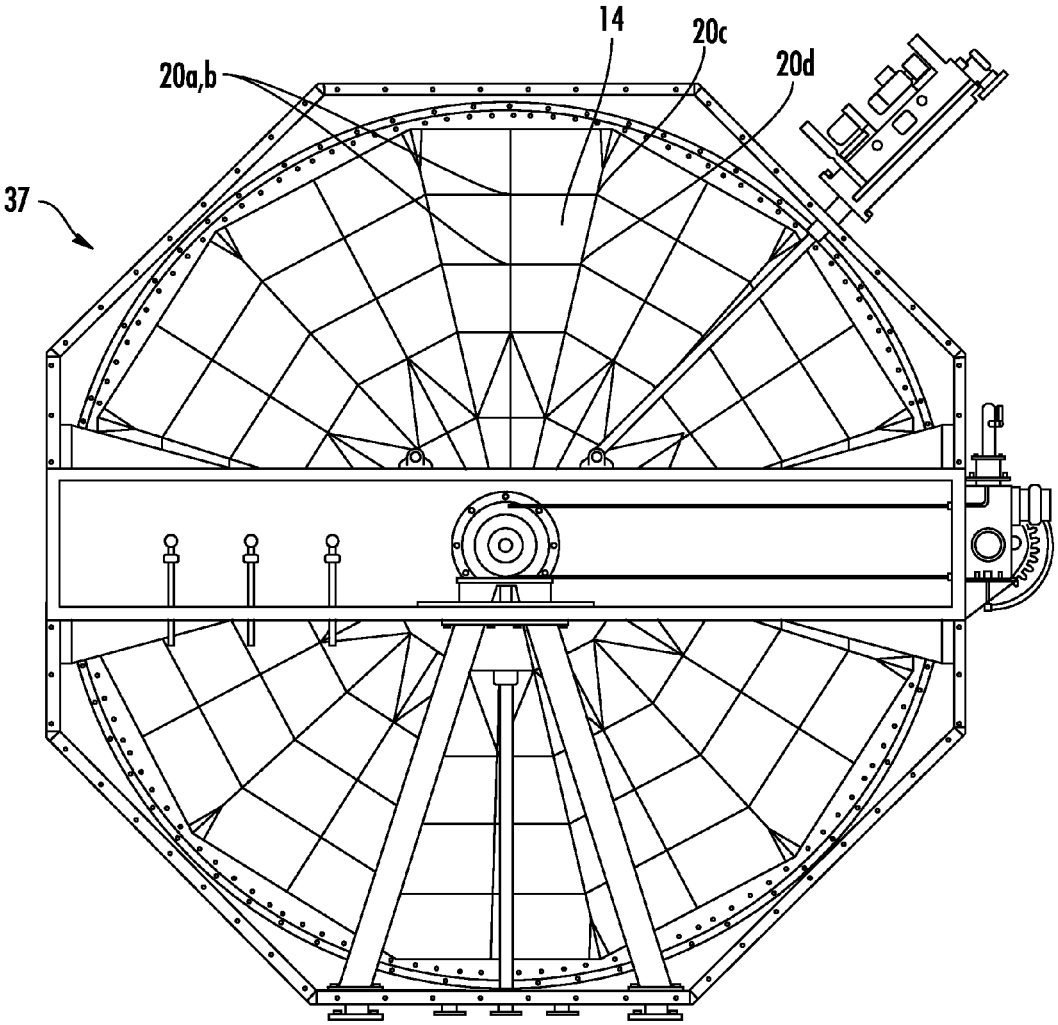
FIG. 9 is a top plan view of an exemplary preheater assembly incorporating the disclosed lifting lug.

As shown in FIG. 8A, the legs 34, 36 may be arranged so that an angle "α" is formed by the intersection of their respective longitudinal axes "L-L." This angle "α" may be in the range of 82.5-degrees to 97.5-degrees so that some embodiments of the lifting lug 18 can be used with heater baskets having a variety of corner geometries. For example, FIG. 9 is a top view of an exemplary preheater 37 including a plurality of individual heater baskets 14. The exemplary illustrated heater basket 14 has a trapezoidal shape which includes four corners 20, none of which have the same corner angle. For example, the first and second corners 20*a* have corner angles of 90-degrees, the third corner 20*c* has a corner angle of 87.5-degrees, and the fourth corner 20*d* has an angle of 97.5-degrees. Thus, in the illustrated embodiment, the disclosed lifting lug 18 can be manufactured in three different angular configurations to fit each corner configuration of this non-square heater basket 14.

The hook engaging portion 32 has a round cross-section which, as will be appreciated, allows it to be engaged by a lifting hook at a variety of angular orientations. As can be seen in FIGS. 8A and 8B, the hook engaging portion has an outer surface that is recessed below a plane formed by lower surfaces of the first and second legs 34, 36. That is, the hook engaging portion is offset slightly from the corner portion 30 so that a recess 44 is formed on one side of the lifting lug 18. In use, the lifting lug 18 is oriented so that this recess 44 faces the heating elements 22 (see FIG. 10B) and serves to center a lifting hook, as will be described in more detail later.

The corner portion 30 of the lifting lug 18 may also include an alignment feature, which in the illustrated embodiment is a pair of longitudinal notches 46 formed at distal ends of the legs 34, 36. In the illustrated embodiment, the longitudinal notches 46 are formed on side surfaces 35 (FIG. 8A) of the legs 34, 36. These longitudinal notches 46 may be used to align the lifting lug 18 with the grid members 16 of the heater basket 14 so that a desired positioning of the lifting lug 18 can be achieved without the need for an alignment jig or other additional alignment equipment.

Figure 10:
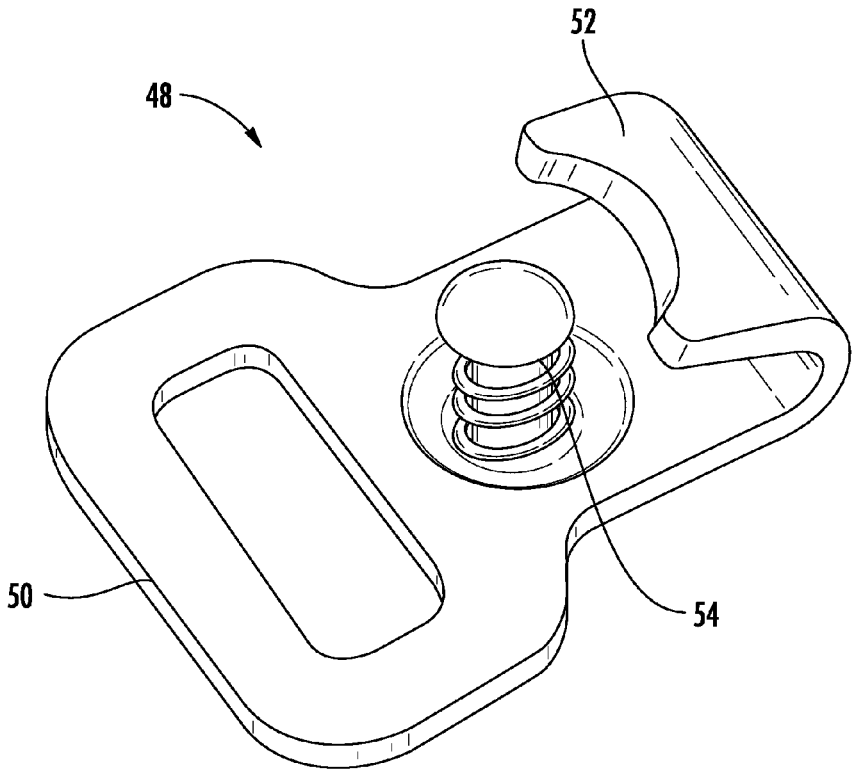
FIG. 10 is an isometric view of an exemplary hook element for use with the disclosed lifting lug.
Figure 11B:
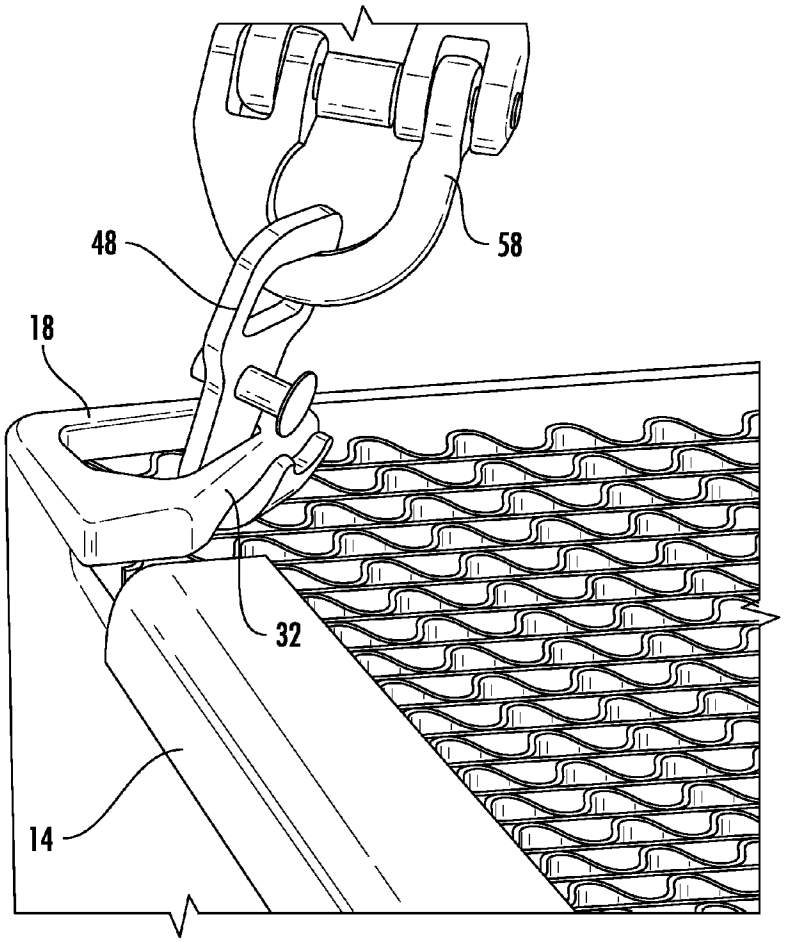
FIGS. 11A and 11B are isometric views showing the hook element of FIG. 10 engaged with the disclosed lifting lug.
Figure 11A:
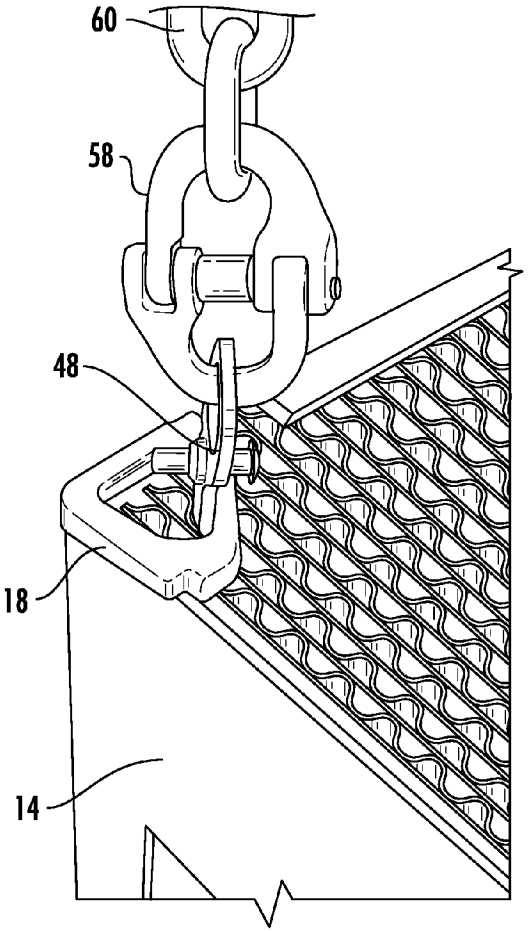

FIG. 10 shows an exemplary hook element 48 for use in engaging the disclosed lifting lug 18. The hook element 48 includes a shackle-engaging portion 50, a J-shaped lug engaging portion 52, and a spring-biased keeper element 54. FIGS. 11A and 11B show the hook element 48 engaged with the disclosed lifting lug 18 engaged with an exemplary low profile heater basket 14. As can best be seen in FIG. 11B, when the hook element 48 is engaged with the hook engaging portion 32 of the lifting lug 18, the keeper element 54 prevents the hook engaging portion 32 and the lug engaging portion 52 from inadvertently disengaging from each other, thus providing a desired degree of enhanced safety as compared to prior devices. To disengage the hook element 48 from the lifting lug 18, the keeper element 54 is pressed inward so that it doesn't interfere with the movement of the hook engaging element 48 of the lifting lug as it passes by.

Figure 12:
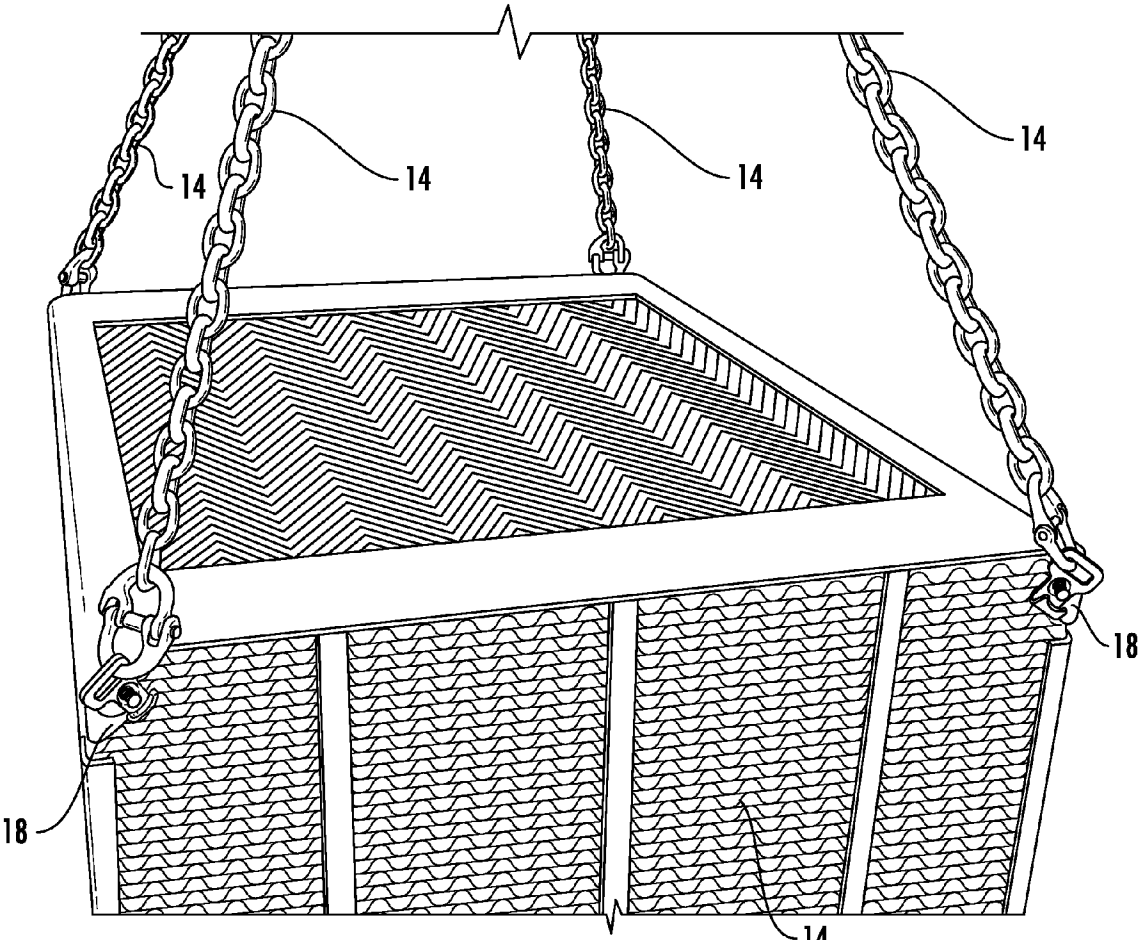
FIG. 12 is an isometric view of a low profile heater basket being lifted with the disclosed lifting lugs and lifting elements.

As shown in FIGS. 11A and 11B, the lifting arrangement may further include a shackle 58 (one per lifting lug 18), and a chain sling 60 for coupling the shackles to a lifting apparatus such as a crane (not shown). FIG. 12 shows the further versatility of the disclosed lifting lug 18, illustrating its use to lift a heater basket 14 positioned in a rotated orientation. As will be appreciated, this orientation is easily accommodated by both the lifting lug 18 and the hook element 48.

The disclosed lifting lug 18 provides a variety of benefits as compared to prior designs. For example, the lifting lug 18 supports minimum height requirements inside the heater basket (i.e., it does not protrude into the interior of the basket), thus enabling maximum sizing of the heating elements inside the basket. The disclosed design allows for fast and easy coupling of the hook elements 48 positioned at the ends of the shackles 60. As previously noted, the presence of large central opening 24 results in minimum obstruction of air/gas flow through the heating elements 22. In addition, the disclosed design results in high mechanical strength, sufficient to survive repeated loadings over the lifetime of the associated heater basket.

The disclosed design further provides safe handling, due to the use of the hook element 48 which includes a keeper element 54, thus eliminating the risk of disengaging the hook from the lifting lug during basket handling operations. In addition, with the disclosed lifting lug design, the time required to set up and remove the baskets is substantially decreased as compared to prior "threaded hole" designs, since the user can simply and quickly clip the hook elements onto the lifting lugs.

The disclosed design also provides better long term durability compared with the prior arrangements that use threaded flat plates as the threads are easily damaged due to corrosion. Slight corrosion of the disclosed lifting lug 18 will have insubstantial impact on lifting operations.

While the present invention has been disclosed with reference to certain embodiments, numerous modifications, alterations and changes to the described embodiments are possible without departing from the spirit and scope of the invention, as defined in the appended claims. Accordingly, it is intended that the present invention not be limited to the described embodiments, but that it has the full scope defined by the language of the following claims, and equivalents thereof.

What is claimed is:

1. A lifting apparatus comprising:

a corner portion including first and second legs configured to attach to a corner of a heater basket frame of a heater basket, the first and second legs coupled to each other at respective first ends thereof, the first and second legs further oriented at an angle with respect to each other;

a hook engaging portion having first and second ends coupled to respective second ends of the first and second legs, the hook engaging portion extending over an interior of the low profile heater basket in a plane substantially parallel to an upper plane of the heater basket defined by a plurality of corners of the heater basket frame; and wherein the hook engaging portion has a cylindrical cross-sectional shape.

2. The lifting apparatus of claim 1, wherein the second ends of the first and second legs each include a longitudinal notch formed in a side surface of the associated leg.

3. The lifting apparatus of claim 1, wherein the angle is from 82.5 degrees to 97.5 degrees.

4. The lifting apparatus of claim 1, wherein the first and second legs have flat upper and lower surfaces.

5. The lifting apparatus of claim 1, the first and second legs and the hook engaging portion comprising a triangular shape.

6. The lifting apparatus of claim 1, wherein the first and second legs and the hook engaging portion form an opening therebetween.

7. The lifting apparatus of claim 6, wherein the opening is pentagonal in shape.

8. A lifting arrangement for a low profile heater basket, comprising:

a plurality of grid members coupled together to form a heater basket frame;

a plurality of lifting lugs coupled to respective corners of said heater basket frame, each of said plurality of lifting lugs comprising a corner portion including first and second legs, and a hook engaging portion having first and second ends coupled to respective second ends of the first and second legs, the hook engaging portion extending over an interior of the low profile heater basket in a plane substantially parallel to an upper plane of the heater basket defined by a plurality of corners of the heating basket; and wherein the first and second legs of each of said plurality of lifting lugs are configured to conform with said respective corners of said heater basket frame.

9. The lifting arrangement of claim 8, wherein said side surfaces of said first and second legs are welded to said respective corners.

10. The lifting arrangement of claim 8, wherein the first and second legs of each of said lifting lugs comprises a longitudinal notch formed in a side surface thereof, and wherein at least one longitudinal notch is aligned with an adjacent grid member to thereby align the associated lifting lug with the heater basket frame.

11. The lifting arrangement of claim 8, wherein the hook engaging portion has a cylindrical cross-sectional shape.

12. The lifting arrangement of claim 11, wherein an outer surface of the hook engaging portion is recessed from a plane formed by bottom surfaces of the first and second legs of the corner portion.

13. The lifting arrangement of claim 8, wherein the first and second legs of the corner portion are angled with respect to each other.

14. The lifting arrangement of claim 13, wherein the angle is from 82.5 degrees to 97.5 degrees.

15. The lifting arrangement of claim 8, wherein the first and second legs have flat upper and lower surfaces.

16. The lifting arrangement of claim 8, wherein the first and second legs and the hook engaging portion comprising a triangular shape.

17. The lifting arrangement of claim 8, wherein the first and second legs and the hook engaging portion form an opening therebetween.

18. The lifting arrangement of claim 8, wherein the opening is pentagonal in shape.

19. The lifting arrangement of claim 8, further comprising a plurality of hook elements for releasably engaging respective hook engaging portions of the plurality of lifting lugs.

20. The lifting arrangement of claim 19, further comprising a plurality of shackles for engaging the plurality of hook elements, and a sling attached to the plurality of shackles, the plurality of shackles, the plurality of hook elements, and the sling for lifting the heater basket frame via said plurality of lifting lugs.

* * * * *